United States Patent [19]

Dodson, Jr.

[11] Patent Number: 4,489,462

[45] Date of Patent: Dec. 25, 1984

[54] AIR FLOW CONTROL APPARATUS FOR A FIBER AIR-LAY MACHINE

[75] Inventor: William C. Dodson, Jr., Nashville, Tenn.

[73] Assignee: E. I. Du Pont de Nemours and Company, Wilmington, Del.

[21] Appl. No.: 476,424

[22] Filed: Mar. 17, 1983

[51] Int. Cl.[3] ..... D01G 25/00

[52] U.S. Cl. ..... 19/306; 19/296

[58] Field of Search ..... 19/305, 304, 306, 296; 406/12, 11

[56] References Cited

U.S. PATENT DOCUMENTS

| | | | |
|---|---|---|---|
| 2,195,158 | 3/1940 | Watts . | |
| 3,581,706 | 6/1971 | Rasmussen . | |
| 3,768,120 | 10/1973 | Miller . | |
| 3,777,231 | 12/1973 | Guschin . | |
| 3,787,195 | 1/1974 | Kirchheim . | |
| 3,806,289 | 4/1974 | Schwarz . | |
| 3,906,588 | 9/1975 | Zafiroglu | 19/306 |
| 4,061,485 | 12/1977 | Rimmel . | |
| 4,074,393 | 2/1978 | Hicklin et al. . | |
| 4,099,296 | 7/1978 | Gustavsson . | |
| 4,106,163 | 8/1978 | Desverchere | 19/296 |
| 4,154,485 | 5/1979 | Lytton et al. . | |
| 4,176,427 | 12/1979 | Neuenschwander . | |
| 4,437,609 | 3/1984 | Johannson | 406/12 X |

*Primary Examiner*—Henry S. Jaudon
*Assistant Examiner*—J. L. Kravitz

[57] ABSTRACT

An apparatus is disclosed for high speed production of uniform webs by air-laydown of textile fibers. A feed batt of staple fibers is fed to a toothed disperser roll that projects the fibers at high velocity and low angle into an airstream of high uniform velocity and low turbulence to form a thin fiber stream from which the fibers are subsequently separated on a moving screen in the form of a web. Air flow control means upstream of the toothed dispenser roll deflects the air stream at a constantly varying angle of deflection to improve fiber laydown uniformity.

3 Claims, 3 Drawing Figures

AIR FLOW CONTROL APPARATUS FOR A FIBER AIR-LAY MACHINE

BACKGROUND OF THE INVENTION

This invention relates to an air-laydown apparatus for assembling textile fibers into webs, and is more particularly concerned with improvements in dispersing and transporting textile fibers in an air stream for collection on a moving screen to form webs which are suitable for use in producing high quality nonwoven fabric.

Nonwoven fabrics are produced from fibrous webs by bonding or interlocking the fibers to provide durability and strength. The fibers of the web may be hydraulically entangled by treatment with high energy liquid streams as disclosed in Evans U.S. Pat. No. 3,485,706, issued Dec. 23, 1969. When producing relatively heavy weight textile fabric, Lauterbach U.S. Pat. No. 2,910,863, issued Nov. 3, 1959, discloses that fiber interlocking may be initiated by treatment with a needle loom and completed by crimping or shrinking the fibers. Production of bonded nonwoven fabrics may be accomplished as disclosed in Graham U.S. Pat. No. 2,765,247, issued Oct. 2, 1956. The quality of fabric produced by these methods depends upon the quality and uniformity of the web which is treated.

Webs suitable for producing high quality nonwoven fabrics, by treatments of the above type, can be prepared by air laydown of textile fibers. Prior art air-laydown processes and apparatus are illustrated by Miller U.S. Pat. No. 3,768,120 issued Oct. 30, 1973, Zafiroglu U.S. Pat. No. 3,906,588 issued Sept. 23, 1975 and Neuenschwander U.S. Pat. No. 4,176,427 issued Dec. 4, 1979. Staple fibers are shipped as a compacted mass. Conventional picking and carding operations are used to separate the fibers. The resulting loosely opened fiber lap is fed to a toothed disperser roll and a stream of air is sucked or blown over the roll. The roll is rotated at high speed to feed the fibers into the air stream, the objective being to feed individual fibers rather than clumps or groups of fibers. The fibers are carried by the air stream through a conduit to the screen surface of a condenser roll or conveyor, where the fibers are deposited over a relatively large surface area to form a layer on the moving screen. The Zafiroglu patent discusses the importance of air turbulence for providing a generally uniform distribution of fibers over relatively large areas throughout the conduit. The Miller patent discusses the importance of air-flow control means adjacent the opposite edges of the screen for shifting the fiber stream rapidly back and forth to even out fiber depositions so that streaks do not form.

SUMMARY OF THE INVENTION

The present invention is an improvement in air-laydown apparatus for assembling textile fibers into a web of the type having duct means for conveying fibers in a controlled flow of air, fiber disperser means for projecting fibers into the duct means to form a stream of fibers in air, air supply means for directing a low turbulence flow of air through the duct means, and condenser means for collecting the fibers on a moving screen to form a web. The duct means includes sidewalls and endwalls forming a rectangular cross-section of at least the width of the web. One of the sidewalls has an opening through which the fibers are projected. The walls are substantially straight and parallel up to this opening to maintain the air in stable flow over the opening. The fiber disperser means comprises a toothed disperser roll, suitable for rotation at a surface speed of at least 9400 feet per minute, and a stationary disperser plate having a curved surface spaced from the roll teeth. This spacing is less than 0.125-inch from a point where the fibers are picked up by the roll teeth to a point where they are projected into the air stream, to form a narrow slit where the fibers are projected through the opening into the duct by inertia. The improvement is in providing air-flow control means upstream of the fiber disperser roll for deflecting the flow of air at a continuously varying angle of deflection. In the preferred embodiment the air-flow control means comprises a rotatably driven shaft mounted in the duct means upstream of the fiber disperser means and aligned transversely of the moving screen. A plurality of equispaced vanes are attached to the shaft in a parallel array at an angle to the shaft. In one embodiment the vanes are circular discs oriented at an angle of 9 degrees to the shaft.

DETAILED DESCRIPTION OF THE PREFERRED EMBODIMENT

Figure 1:
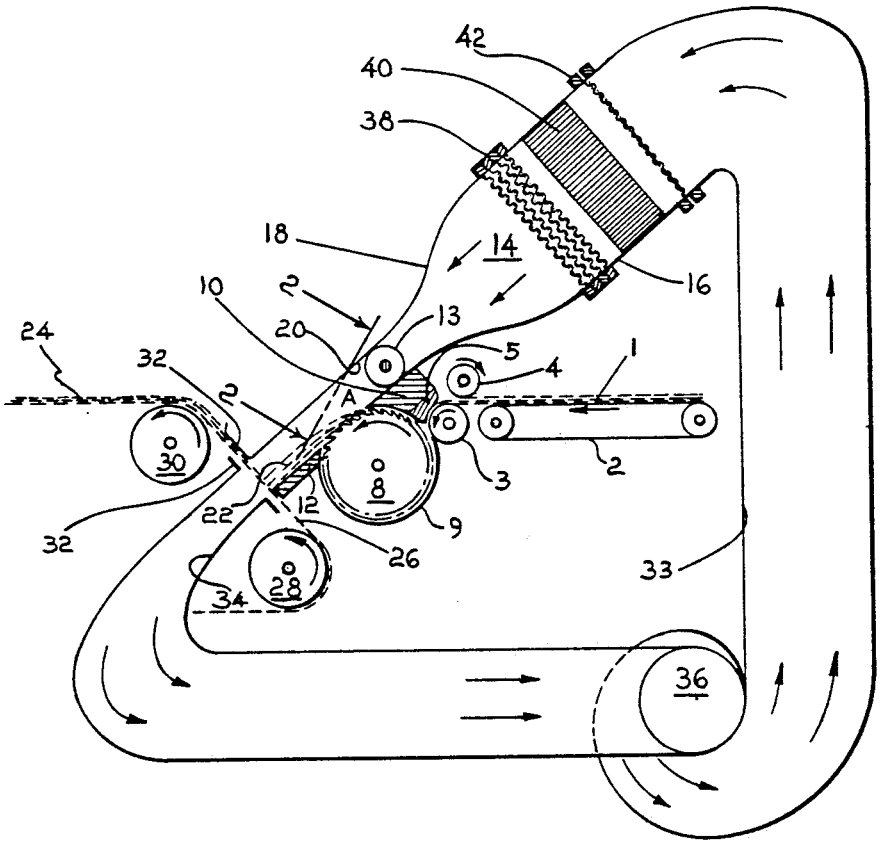
FIG. 1 is a longitudinal vertical sectional view of a form of air-laydown apparatus illustrating use of one embodiment of the invention.

Referring now to FIG. 1, there is shown a fiber feeding means consisting, in this embodiment, of a conveyor belt 2, feed roll 3, compressing roll 4 and shoe 5 for supplying fiber 1 to the disperser roll 8. The fiber feeding means is designed to feed a batt of staple fibers having a weight which is about 3 to 150 times the weight of the web to be produced. The disperser roll separates the fibers and carries them mixed with the air adjacent to the roll surface through the space between the roll and disperser plate 10, and discharges this mixture centrifugally into duct 20 at Zone A. A shroud or casing 9 extends around the disperser roll from the lower edge of doff-bar 12 to feed-roll 3. The fibers projected from the disperser roll form a thin fiber stream 22 in air flowing through the duct and are then separated from the air as web 24 on condenser screen 26.

Air is supplied from air passage 14, which has larger cross-sectional dimensions than the duct 20. The parallel walls 16 of the air passage are connected to the duct walls 20 by converging section 18 of the flow nozzle configuration. Screens 38 and 42, and honeycomb structure 40, provide a uniform flow substantially free of turbulence and vorticity. Air is blown into the air passage 14 and through air-flow control means 13 by one or more fans 36, through a duct system 33, shown diagrammatically.

The fibers are deposited to form a web on continuous, moving screen 26 which is driven and supported by rolls 28 and 30. The air flows through the screen and is withdrawn through vacuum duct 34. The air may be filtered to remove any particles passing screen 26 and then be recirculated to fan 36. Several fans in series or an open air system with one or more fans supplying the air and one or more fans exhausting the air can also be used. The screen 26 is sealed against the fiber duct 20 and the vacuum duct 34 by sealing means 32 such as a plate of polyethylene.

Figure 2:
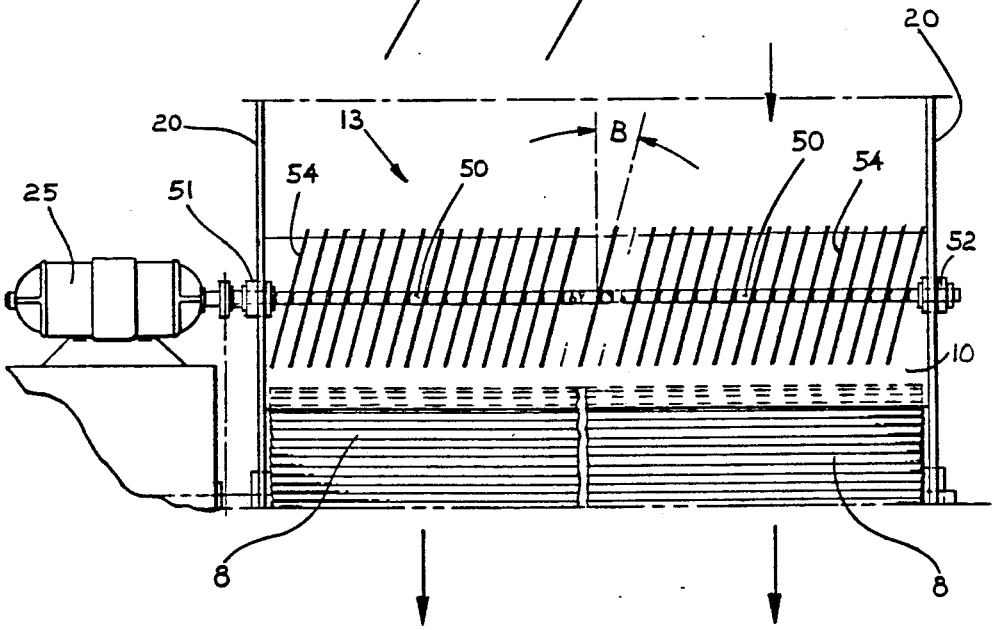
FIG. 2 is a plan view of the air-flow control means of the invention taken along line 2—2 of FIG. 1.
Figure 3:
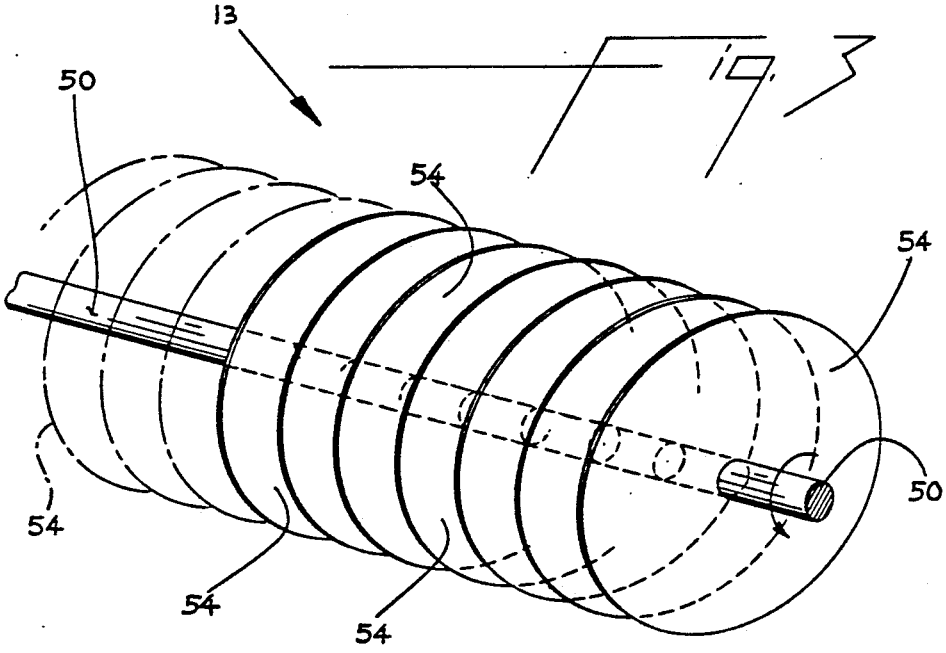
FIG. 3 is an enlarged perspective view of the air-flow control means of the invention.

FIGS. 2 and 3 show the air-flow control means 13, in greater detail. More particularly, a shaft 50, driven by variable speed motor 25, is rotatably mounted to duct walls 20 in bearings 51, 52. A center support bearing (not shown) for the shaft 50 is provided. The shaft is located upstream of the disperser roll 8 and oriented transverse of the screen 26. A plurality of discs 54 are attached to shaft 50 in a parallel array at an angle B of from about 9 to about 20 degrees to a plane perpendicular to the shaft. In a preferred arrangement the discs 54 are mounted parallel to each other and equally spaced apart on shaft 50 which is driven at a speed of from about 2500 to about 3000 rpm by motor 25.

In operation, as the discs 54 rotate, the air flow direction of the entraining air is altered just before it encounters the centrifugally doffed fibers leaving disperser roll 8. The air stream is caused to sweep across the disperser roll by the rotation of the discs. The sweep averages out more and less dense portions of the fiber stream, giving uniform web formation on the screen.

EXAMPLE

A disc assembly (13) is prepared from forty-one 2⅛ in (5.4 cm) aluminum discs, 0.030 in (0.076 cm) thick. The discs have 0.25 in (0.64 cm) concentric holes and are strung on a 0.25 in (0.64 cm) diameter steel shaft (50). Spacing and parallelism is maintained by slipping each disc edgewise into the parallel slots of a jig where the slots are on 0.75 in (1.9 cm) centers. Then by setting the shaft at 81 degrees to the parallel slots, a deflection angle (B) of 9 degrees is imparted to all the discs. Aluminum filled epoxy is applied to the junctions of the shaft and discs while they are held in this relationship. In addition, a support bearing is provided between the two central discs during assembly.

The assembly is mounted in the air lay duct (20) of an experimental, 36 in (91 cm) wide web forming machine by means of sleeve bearings in the side plates, and the central bearing on a support inserted upward through a slot in the duct cover. The shaft is centered vertically in the duct leaving 0.125 in (0.32 cm) clearance top and bottom for the discs. It is located 6.5 in (16.5 cm) downstream from the flow nozzle section (18) and aligned perpendicular to the airflow. The shaft is driven by a variable speed motor 25 mounted on the disperser bearing housing. Webs of polyester staple made with the deflector shaft rotating at 3000 rpm show no trace of the sweep at up to 64 ypm (60 mpm) laydown belt speed. The web uniformity is visually superior to a web produced under similar conditions but without the rotating vanes. Analysis of a series of webs made at several throughput rates substantiates this observation as shown by Table 1. The average basis weight profile of products made during this test is determined by the average of five cross direction profiles obtained by weighing one in (2.5 cm)×three in (7.6 cm) specimens. The specimens are taken sequentially next to each other across the web width.

TABLE 1

| | Rotatable Basis Weight, $\overline{X}$ | | | | | |
|---|---|---|---|---|---|---|
| Throughput lbs/in hr | g/cm hr | Vanes | oz/yd$^2$ | g/m$^2$ | Std. Dev. | Coefficient of Variation, % |
| 3 | 536 | No | 1.98 | 67.1 | 0.148 | 7.6 |
| 3 | 536 | Yes | 1.87 | 63.4 | 0.095 | 5.1 |
| 12 | 2143 | No | 0.89 | 30.2 | 0.288 | 32.5 |
| 12 | 2143 | Yes | 1.09 | 37.0 | 0.098 | 9.0 |
| 12 | 2143 | No | 1.66 | 56.3 | 0.168 | 10.2 |
| 12 | 2143 | Yes | 1.56 | 52.9 | 0.075 | 4.8 |
| 12 | 2143 | Yes | 1.57 | 53.2 | 0.077 | 4.9 |

I claim:

1. In an air-laydown apparatus having duct means for conveying fibers in a flow of air, fiber disperser means for projecting fibers into the duct means to form a stream of fibers in air, an air supply for directing a flow of air through the duct means and a moving condenser screen for collecting the fibers thereon to form a web, the improvement comprising: air-flow control means located in said duct means upstream of said fiber disperser means, for deflecting the flow of air at a continuously varying angle of deflection.

2. In an air-laydown apparatus having duct means for conveying fibers in a flow of air, fiber disperser means for projecting fibers into the duct means to form a stream of fibers in air, an air supply for directing a flow of air through the duct means and a moving condenser screen for collecting the fibers thereon to form a web, the improvement comprising: a rotatably driven shaft mounted in said duct means upstream of said fiber disperser means, said shaft being aligned transversely of said screen; and a plurality of equispaced vanes attached to said shaft, said vanes being parallel to each other and at an angle to the shaft to deflect the flow of air at a continuously varying angle of deflection.

3. The apparatus of claim 2, said vanes being discs oriented at an angle of about 9 degrees to said shaft.

* * * * *